United States Patent [19]

Yamashita

[11] Patent Number: 4,649,725

[45] Date of Patent: Mar. 17, 1987

[54] DOOR LOCK

[75] Inventor: Toshihiko Yamashita, Osaka, Japan

[73] Assignee: Uniqey International Ltd., Kowloon, Hong Kong

[21] Appl. No.: 764,875

[22] Filed: Aug. 12, 1985

[30] Foreign Application Priority Data

Aug. 21, 1984 [JP] Japan ..... 59-127114[U]

[51] Int. Cl.[4] ..... E05B 55/14

[52] U.S. Cl. ..... 70/472; 70/413; 70/276; 70/149; 292/DIG. 27

[58] Field of Search ..... 70/472, 467, 413, 487, 70/149, 276, 218; 292/251.5, 169, 169.14, 169.17, DIG. 27

[56] References Cited

U.S. PATENT DOCUMENTS

| | | | |
|---|---|---|---|
| 305,684 | 9/1884 | Ewing | 70/419 |
| 504,462 | 9/1893 | Tinkham | 70/149 |
| 632,959 | 9/1899 | Clement | 292/DIG. 27 |
| 1,043,750 | 11/1912 | Arens | 70/487 |
| 1,234,519 | 7/1917 | Williams | 292/DIG. 27 |
| 1,751,184 | 3/1930 | Wodarra | 70/149 |
| 2,072,317 | 3/1937 | Simpson | 70/149 |
| 2,075,948 | 4/1937 | Kuszmaul | 70/149 |
| 2,162,704 | 6/1939 | Dall | 292/DIG. 27 |
| 2,459,029 | 1/1949 | Ingres et al. | 292/DIG. 27 |
| 2,644,705 | 7/1953 | Hagstrom | 292/153 |
| 3,807,203 | 4/1974 | Larsen | 70/149 |
| 3,919,869 | 11/1975 | Fromm | 70/413 |
| 4,114,410 | 9/1978 | Astier | 70/355 |
| 4,255,953 | 3/1981 | Dietrich et al. | 292/DIG. 27 |

FOREIGN PATENT DOCUMENTS

| | | | |
|---|---|---|---|
| 157551 | 12/1939 | Fed. Rep. of Germany | 70/218 |
| 606589 | 8/1948 | United Kingdom | 70/134 |

*Primary Examiner*—Thomas J. Holko
*Assistant Examiner*—Suzanne L. Dino
*Attorney, Agent, or Firm*—Learman & McCulloch

[57] ABSTRACT

A door lock in which the lock bolt is not retracted by direct action of the handles but is instead retracted by slide members acted upon by the handles, the slide members having means for engaging a further slide which carries the bolt. One of the engagement means includes an electromagnet and an engagement member. The engagement member engages the bolt carrying slide only when the electromagnet is energized, which occurs when an appropriate key has been inserted into the lock and verified.

6 Claims, 3 Drawing Figures

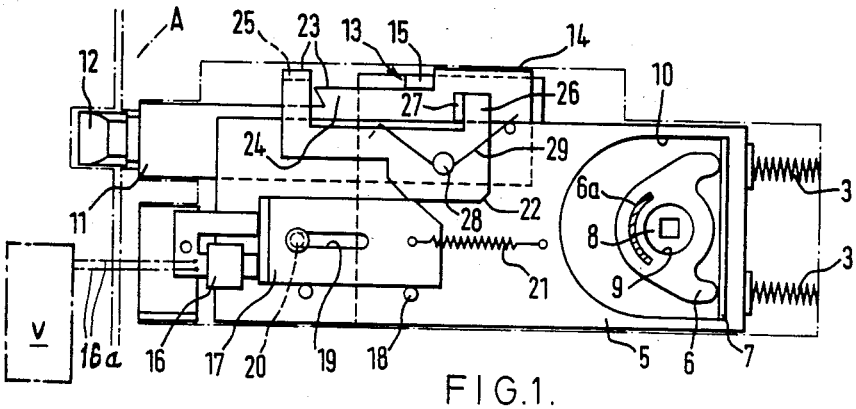
FIG.1.
FIG.2.
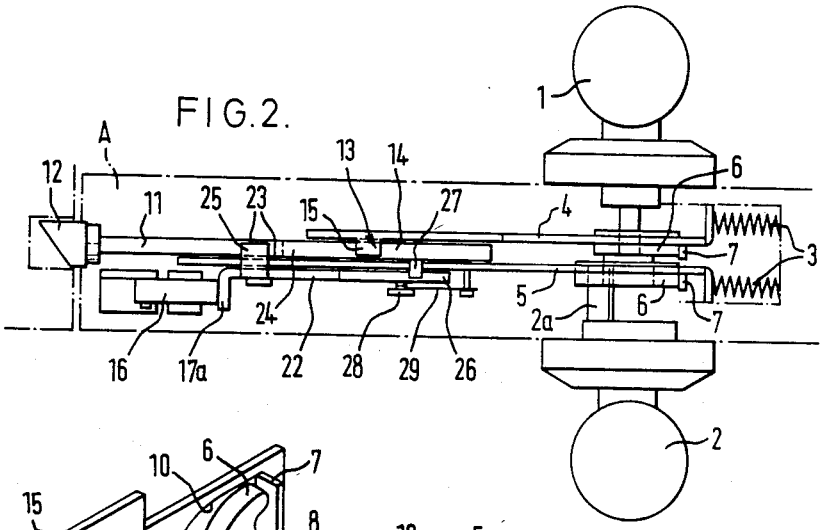
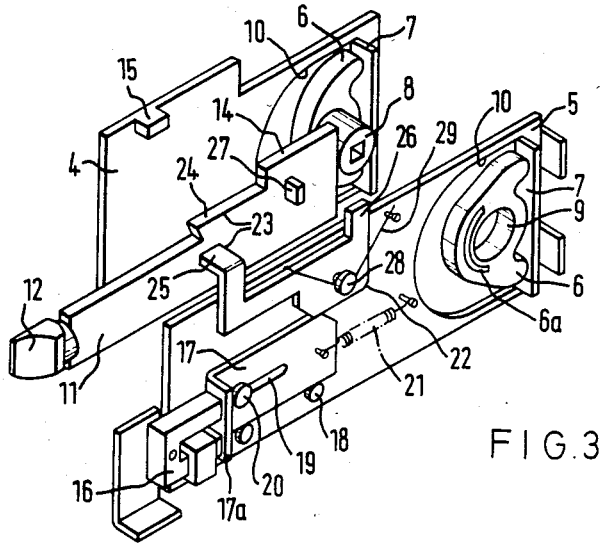
FIG.3.

DOOR LOCK

BACKGROUND OF THE INVENTION

This invention relates to a door lock.

In locks of the type in which a lock bolt is retracted by operating a handle to retract a slide carriage which carries the bolt, various methods have been employed to prevent retraction of the slide carriage until the lock is operated by an appropriate key. In one such method use of the key causes a plate piece to rotate resulting in engagement of notches in the front end of the plate piece with the slide carriage. In another such method, the key acts via a linkage to raise a blocking plate which is located between the rear end of the slide carriage and the rear wall of the lock case.

These conventional locks suffer the disadvantage that if an instrument such as a pipe wrench is used to forcibly turn the handle, the lock's security is impaired since the mechanism may be broken.

SUMMARY OF THE INVENTION

According to the present invention there is provided a door lock comprising: an inner door handle, an outer door handle, an inner slide member, an outer slide member, an intermediate slide member, a lock bolt, means providing a restoring force, first engagement means and second engagement means, the door handles being operable independently of each other with operation of either handle causing the respective slide member to be retracted against the restoring force, the intermediate slide member carries the lock bolt and the first engagement means provides engagement between the inner slide member and the intermediate slide member such that the intermediate slide member is retracted together with the inner slide member upon rotation of the inner door handle, the second engagement means being operable to provide engagement between the intermediate slide member and the outer slide member such that the intermediate slide member is retracted together with the outer slide member upon operation of the outer door handle, the second engagement means including an electromagnet and an engagement member, the electromagnet being energized upon insertion into the lock, and verification of an appropriate key and energization of the electromagnet causing the engagement member to engage the intermediate slide member thus operating the second engagement means.

BRIEF DESCRIPTION OF THE DRAWINGS

An embodiment of the present invention will now be described, by way of example only, and with reference to the accompanying drawings, in which:

FIG. 1 is a front view of an embodiment of the invention;

FIG. 2 is a plan view of the embodiment shown in FIG. 1; and

FIG. 3 is an exploded perspective view of the embodiment of FIG. 1.

DESCRIPTION OF THE PREFERRED EMBODIMENT

In the drawings, A is a door which is hinged to a door frame and which has independently rotatable handles 1 and 2. The handles, which may be of either lever or knob form, are provided opposite one another on the inside (inner) and outside (outer) surfaces of the door, respectively.

The door A is further provided with an inner door slide 4 and an outer door slide 5. These slides are retracted by rotation of the respective handles and are subjected to a restoring force by springs 3.

As best seen from FIGS. 1 and 3 of the drawings, the inner and outer slide members are retracted by the action of respective cams 6 upon operating surfaces 7 which project from the respective slide members. This arrangement is in essence the conventional D-lever type system but with a variation to enable the cams to rotate independently of each other. The outer cam 6 is held in position by being rotatably mounted on a shaft 8 which projects from the inner cam 6. The inner cam 6 is operated by a square shaft via which the cam is attached to the inner door handle. As can be seen from FIG. 2, the outer door handle 2 operates the outer cam 6 by way of a spigot **2*a* which cooperates with a slot 6*a* provided in the outer cam 6. The inner and outer slide members 4 and 5 are provided with cut-away portions 10 such that the slide members 4 and 5 do not foul with the cams 6 when the slide members 4 and 5** are retracted.

Located between the inner slide member 4 and the outer slide member 5 is an intermediate slide member 11 which carries the lock bolt 12. FIG. 2 illustrates the locked position with the lock bolt 12 extending into an appropriate recess in the door frame.

A first engagement means 13 is provided between the inner slide member 4 and the intermediate slide member 11. The first engagement means 13 consists of a projection 15 which extends laterally from the inner slide member 4 and an abutment piece 14 provided at the rear of the upper edge of the intermediate slide 11. As the inner slide member 4 is retracted, by operation of the handle 1, the projection 15 contacts the front edge of the abutment piece 14 and consequently the intermediate slide member 11 is retracted together with the inner slide member 4. Thus, rotation of handle 1 results in retraction of the lock bolt 12 so that the door may be opened. When the handle 1 is released the inner slide member 4 is returned to its original position under the action of one of the springs 3 and the intermediate slide member 11 is returned to its original position in a manner described below.

A second engagement means is associated with the outer slide member 5. The second engagement means includes an electromagnet 16 and an engagement member 22. The engagement member 22 is operable in a manner to be described so as to engage with the intermediate slide member 11 resulting in the member 11 being retracted together with the outer slide member 5 upon rotation of the outer handle 2.

The electromagnet 16 is fixed relative to the door and is energized by electric circuit lines **16*a* under the control of conventional verification means V. The electromagnet 16** is energized when an appropriate key (not shown) has been inserted into a key slot (not shown) and verified. The key may for example be in the form of a magnetic card having a code recorded thereon, which code is checked against a code prestored in the said verification means V.

The engagement member 22 is pivotally attached via pin 28 to the outer slide member 5. A lateral projection 25 is provided on the engagement member 22 and the projection 25 is capable of engaging an abutment piece 24 provided on the upper edge of the intermediate slide member 11. The abutment piece 24 is stepped below the abutment piece 14 so that projection 15 of the inner slide member 4 does not act upon the abutment piece 24 to move the intermediate slide member 11. The projection 25 of engagement member 22 only engages the abutment piece 24 of intermediate slide member 11 when the engagement member 22 pivots in an anti-clockwise direction about pin 28 under the action of a spring 29.

Anti-clockwise rotation of the engagement member 22 is restricted by contact with a control slide 17. Control slide 17 comprises a flat plate having an outwardly turned lip 17*a* at the front edge thereof. The control slide 17 lies flat against the outer slide member 5 and is supported on two rollers 18. The control slide 17 is retained on the outer slide member 5 by a spigot 20 which has a shaft extending through an elongate slot 19 provided in the control slide 17. The control slide 17 is further attached to the outer slide member 5 via a spring 21. The spring 21, slot 19 and spigot 20 enable the control slide 17 to reciprocate linearly along the outer slide member 5. The spring 21 acts on control slide 17 in a rearward direction so that the forward end of slot 19 abuts against spigot 20. The lip 17*a* is capable of being attracted by the electromagnet 16 and when the lock is in its rest position the lip 17*a* abuts against the face of the electromagnet 16.

Operation of the lock upon rotation of the outer handle 2 will now be described.

As handle 2 is rotated the outer slide member 5 is retracted. Assuming that the handle is being rotated without an appropriate key having been inserted into the lock, the electromagnet 16 is not energized and there is no relative movement between the control slide 17 and the outer slide member 15. Hence, the engagement member 22 is still held against rotation under the action of spring 29 by the contact between the member 22 and the control slide 17. Consequently, projection 25 of the engagement means 22 does not engage the abutment piece 24 of the intermediate slide member 11 so that the slide member 11 is unaffected by movement of the slide member 5. The door remains locked.

Assming now that an appropriate key has been inserted in the lock and verified so that electromagnet 16 is energized, the lip 17*a* of control slide 17 is held in contact with the electromagnet 16 by magnetic attraction. If the handle 2 is now rotated the slide member 5 will be retracted but spring 21 will be extended because the control slide 17 is held by the electromagnet 16. The attractive force applied to control slide 17 by the electromagnet 16 is greater than the force applied to control slide 17 by the spring 21 even when slide member 5 is moved to its rearmost position. As the slide member 5 is retracted under operation of handle 2 the spigot 20 is moved along slot 19 and the contacting surfaces of the engagement member 22 and the control slide 17 are shaped so as to permit the engagement member 22 to rotate in an anti-clockwise direction as slide member 5 is withdrawn past control slide 17. Consequently, the projection 25 of the engagement member 22 is brought into contact with the front edge of the abutment piece 24 of intermediate slide member 11. Thus the slide member 11 is retracted together with the slide member 5. The door is therefore unlocked.

It remains to be described how the slide member 11 is returned to the lock position after having been retracted either by operation under the action of handle 2, with use of an appropriate key, or under the action of handle 1. The intermediate slide member 11 is provided with a lateral projection 27 and in the rest position of the lock this abuts against an upstanding projection 26 provided on the engagement member 22. If the outer slide member 5 is retracted without operation of the engagement 23 so as to also retract the slide member 11, then projection 26 moves out of contact with projection 27. If however the slide member 11 is retracted by retraction of slide member 4 then the projection 27 remains in contact with projection 26, thus causing slide member 5 to also be retracted. In these circumstances, when handle 1 is released the slide members 4 and 5 are urged forward by springs 3 and the contact between projection 26 and projection 27 ensures that the intermediate slide member 11 is also urged forwardly. Similarly, if the slide member 11 is retracted by operation of the engagement means 23 then, when handle 2 is released slide carriage 5 moves forward under the action of spring 3, projection 26 contacts projection 27 and thus slide member 11 is also returned to its original position.

From the above description it can be seen that in the absence of an appropriate key being inserted into the lock and verified, the outer handle 2 may be turned but this has no effect upon the slide member 11 and the lock bolt 12. Since there is, in this condition, no action between slide member 5 and slide member 11 it is not possible to impair the security of the lock by the application of excessive force to the handle 2.

Whilst the above description has shown one implementation of the present invention, it will be readily understood by those skilled in the art that modifications can be made without departing from the scope of the invention. In particular, it may be possible to combine the engagement means 22 and control slide 17 into single unit acted upon by the electromagnet 16.

What I claim is:

1. A door lock comprising: an inner door handle, an outer door handle, an inner slide member operably connected with the inner door handle, an outer slide member operably connected with the outer door handle, an intermediate slide member, a lock bolt, means providing a restoring force for said lock bolt, first engagement means and second engagement means, the door handles being operable independently of each other with operation of either handle causing the respective slide member with which it is operably connected to be retracted against the restoring force, the intermediate slide member carrying the lock bolt and the first engagement means providing engagement between the inner slide member and the intermediate slide member such that the intermediate slide member is retracted together with the inner slide member upon rotation of the inner door handle, the second engagement means being operable to provide engagement between the intermediate slide member and the outer slide member such that the intermediate slide member is retracted together with the outer slide member upon operation of the outer door handle, the second engagement means including: an electromagnet, a control slide, an engagement member, and verification means, the verification means causing energization of the electromagnet upon verification that an appropriate key has been inserted into the lock, energization of the electromagnet restraining movement of the control slide relative to the electromagnet which causes the engagement member to effect engagement between the outer slide member and the intermediate slide member so that the intermediate slide member is retracted together with the outer slide member upon operation of the outer handle.

2. A door lock as claimed in claim 1, wherein the engagement member is pivotally mounted on the outer slide member and is restrained from rotation by the control slide, retention of the control slide by energization of the electromagnet permitting the engagement member to rotate as the outer slide member is retracted, resulting in engagement of the intermediate slide member by the engagement member.

3. A door lock as claimed in claim 1 wherein the intermediate slide member is provided with outer slide engaging means which operably cause the outer slide member to be retracted upon retraction of the inner slide member, with the restoring force acting on the outer slide member being transmitted to the intermediate slide by the said outer slide member engaging means.

4. A door lock as claimed in claim 2, wherein the second engagement means includes two rollers and a spigot, the control slide being supported by the two rollers and guided during relative movement between the control slide and the outer slide member by the spigot which is attached to the outer slide member and which extends through an elongate slot in the control slide.

5. A door lock as claimed in claim 1, including an outer cam and an inner cam, wherein rotation of each handle causes rotation of the respective cam and rotation of each cam causes retraction of the respective slide member, and wherein the inner cam has a shaft integral therewith and the outer cam is rotatably mounted on the said shaft.

6. A door lock for use with a verification system permitting unlocking of the door when a verified key or card is inserted comprising: support means; an inner door handle operably mounted thereon; an outer door handle also independently operably mounted thereon; an inner retraction member operably connected to said inner door handle to be slidably retracted by movement of said inner door handle; an outer retraction member operably connected to said outer door handle to be slidably retracted by movement of said outer door handle; an intermediate retraction member having a lock bolt; means providing a restoring force operating to restore said intermediate retraction member and bolt to locked position; first engagement means providing engagement between the inner retraction member and intermediate retraction member so that the intermediate retraction member is slidably retracted with the inner retraction member upon operation of the inner door handle; second engagement means, selectively effecting engagement between the outer retraction member and intermediate retraction member, and operable to provide engagement between the outer retraction member and intermediate retraction member; said second engagement means including: an electromagnet mounted on said support means, an engaging part on said outer retraction member, movable, from an engaged position in which it engages said intermediate retraction member and retracts it with said outer retraction member, to a disengaged position in which it does not engage said intermediate retraction member, a magnetizable control member for said engagement part mounted on said outer retraction member in a position to be energized by said electromagnet, said control member being mounted to permit retraction of said outer retraction member and engaging part, when said control member is restrained from moving by its energization by said electromagnet, and thereby permit said engaging part to move from disengaged to engaged position.

* * * * *